United States Patent [19]

Bailey

[11] 3,982,802

[45] Sept. 28, 1976

[54] DISHWASHER RACK HAVING RETENTION MEANS

[75] Inventor: Paul D. Bailey, Kettering, Ohio

[73] Assignee: General Motors Corporation, Detroit, Mich.

[22] Filed: Nov. 3, 1975

[21] Appl. No.: 628,375

[52] U.S. Cl. ..... 312/348; 312/312; 134/176

[51] Int. Cl.[2] ..... A47B 88/04

[58] Field of Search ..... 5/311, 333, 341, 348, 5/351, 352; 134/176; 308/3.6, 3.8

[56] References Cited

UNITED STATES PATENTS

| | | | |
|---|---|---|---|
| 2,860,929 | 11/1958 | Gussack | 308/3.8 |
| 3,044,842 | 7/1962 | Abresch et al. | 312/348 |
| 3,096,125 | 7/1963 | Kendt | 308/3.8 |
| 3,180,348 | 4/1965 | Clearman | 134/176 |
| 3,347,613 | 10/1967 | Krzewina | 312/348 |
| 3,614,187 | 10/1971 | Cuthbert | 312/351 |
| 3,672,743 | 6/1972 | Pompey | 312/311 |

*Primary Examiner*—Casmir A. Nunberg
*Attorney, Agent, or Firm*—Frederick M. Ritchie

[57] ABSTRACT

An extensible dishwasher rack arrangement has a rail on each side of the dishwasher tub and a dish support rack which has on each side thereof a pair of rollers straddling the rail for supporting the rack as the rack is pulled into a position extending from the tub. Rigid pins project sidewise from the rack to bump the rail and prevent the rack from being lifted in front. An end cap on the outboard end of the rail provides a bumper to stop the rack in its extended position. The end cap includes an integral latch finger which blocks one of the rigid pins to prevent lifting the rack front in its extended position. The latch finger may be flexed out of the way of the blocked pin to facilitate removal of the rack from the rail.

5 Claims, 4 Drawing Figures

DISHWASHER RACK HAVING RETENTION MEANS

This invention relates to a dishwasher and, more particularly, to an improved dish supporting rack therefor.

Prior art dishwashers have included dish support racks movably carried at each side thereof on a support rail. Rack arrangements of this type have also included manually releasable latches for removing the rack from the rail. Such rails may be extensible from the dishwasher by positioning them on rollers attached to the side wall of the dishwashing chamber. Such racks have been carried on each such rail by a pair of horizontally offset rollers that straddle the rail. Each pair of offset rollers in this prior art is near the back of the rack so that the weight of the rack keeps such rollers firmly engaged with the top and bottom of the rail. The rack is installed on the rail by tilting the front of the rack upwardly as the upper roller of each offset pair is positioned on top of the rail. Whereas this procedure is perfectly acceptable to install an empty rack on the rails, a problem arises when the rack is full of dishes and the front of the rack is inadvertently lifted. It is to the solution of this and other problems that this invention is directed.

Accordingly, it is a general object of this invention to provide anti-lift means on a dish rack adapted to be movably carried at each rear side thereof by a pair of rack-mounted, offset rollers straddling a tub-mounted rail.

A more particular object of this invention is the provision on the above dish rack of a pair of horizontally offset rigid members, extending sidewardly from the rack into respective underlying and overlying spaced relationship with the rail and cooperating with the rollers to prevent the front of the rack from being lifted.

A still further object of this invention is the provision on the interchangeable rails for both sides of the above dish rack of an interchangeable cap normally stopping the outward movement of the rack with respect to the rails, said cap having improved latching means for releasing the rack from the rail including a flexible finger in line with one of the rigid members which is forwardly of the rail when the rack is stopped to prevent the lifting of the rack from the rail, said finger adapted to be manually flexed out of the way of the rigid member to permit the lifting of the front of the rack and the subsequent release and removal of the rack from the rail.

Further objects and advantages of the present invention will be apparent from the following description, reference being had to the accompanying drawings wherein a preferred embodiment of the present invention is clearly shown.

IN THE DRAWINGS

Figure 1:
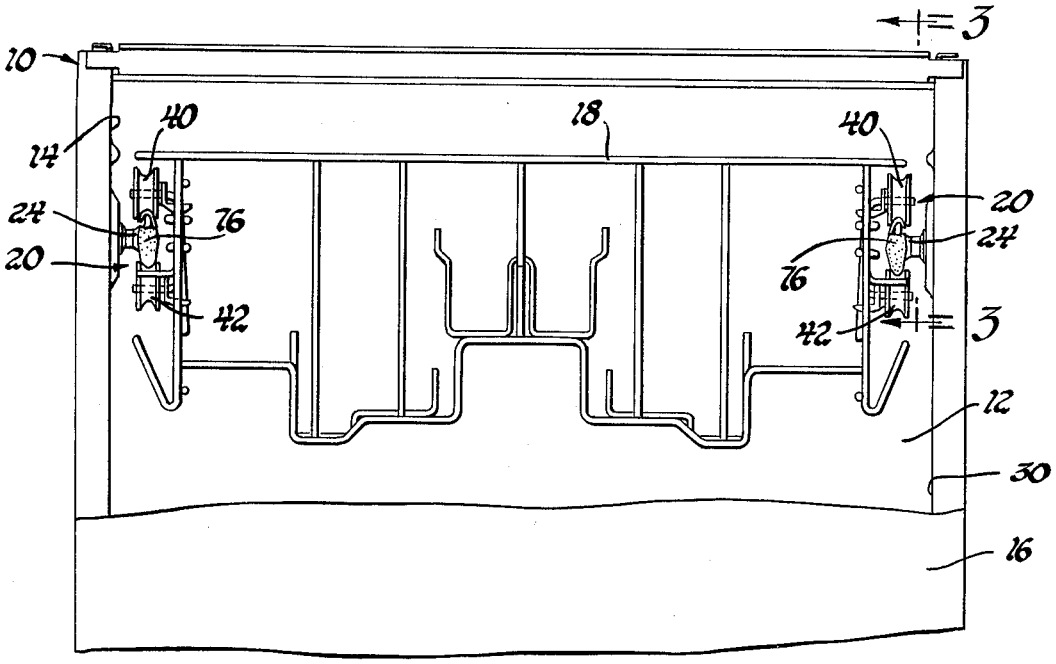
FIG. 1 is a fragmentary front elevational view of dishwasher with part of the door broken away to show the improved dish rack of this invention.
Figure 2:
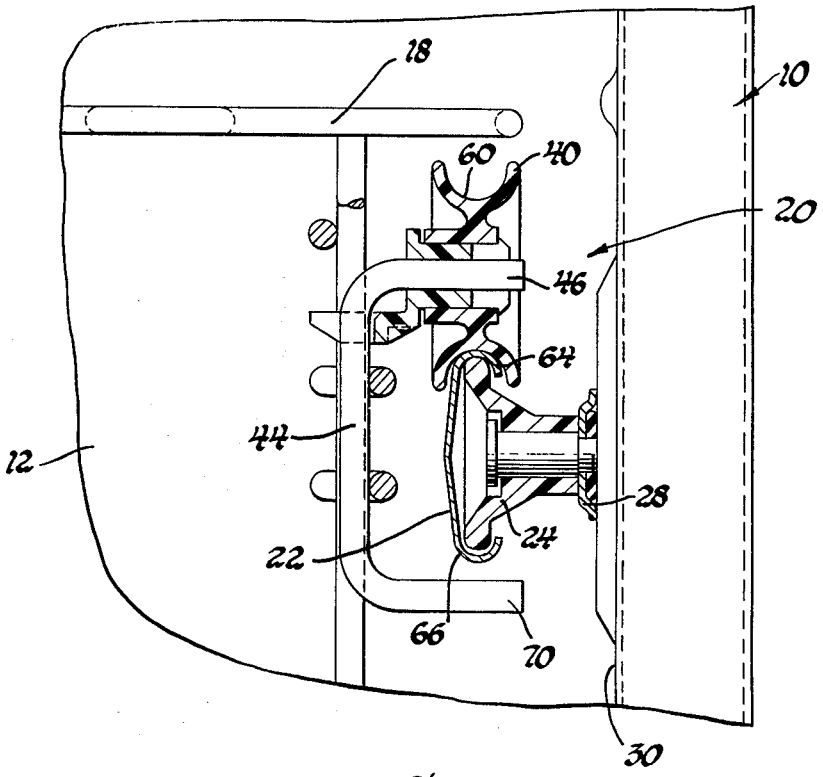
FIG. 2 is an elevational view, partly in section, of one side of the rack shown in FIG. 1 showing in enlarged detail the roller support arrangement for the dish rack.

In accordance with this invention and with reference to FIG. 1, a dishwasher 10 of the front loading type has a washing chamber 12 and an access opening 14 thereto closed by a horizontally hinged door 16. An upper rack 18 for supporting dishes to be washed is slidably mounted in the chamber for movement between a loading position (FIG. 4) wherein the rack extends at least partially out through the access opening and a washing position (FIG. 3) wherein the rack is fully within the chamber and the door closed. This invention is directed to a novel rack support arrangement 20 at each side of the rack. Since the support arrangement is the same on both sides of the rack only one will be described.

A supporting rail 22 is located at each side of said rack. The rail is slidably mounted on a first pair of rollers 24, 26 affixed through a seal washer 28 to a side wall 30 of the dishwashing chamber 12. A pin 32 limits outward travel of the rail when the pin bumps into roller 26. A second pair of rollers 40, 42 are affixed on the rack at the rear thereof. For this purpose, one of the rack wires 44 includes a terminal portion 46 to journal roller 40 while a rack wire 50 includes a terminal portion 52 to journal roller 42. Rollers 40, 42 have channeled peripheries or grooved rims 60, 62 to ride the curled top 64 and curled bottom 66 respectively of the rail. Rollers 40, 42 are both laterally and vertically offset from each other with their grooved rims astride the rail 22 for supporting the rack and preventing it against tipping downwardly during movement between loading (FIG. 4) and washing (FIG. 3) positions. As can be seen from the drawings, any lifting of the front of the rack, intentional as well as inadvertent, will cause roller 40 to act as a fulcrum and the grooved rim of roller 42 to tend to become disassociated from the rail. In this event rack 18 would not be held in secure lateral alignment, thereby raising the possibility that the rack would become completely dislodged from the rails.

Figure 3:
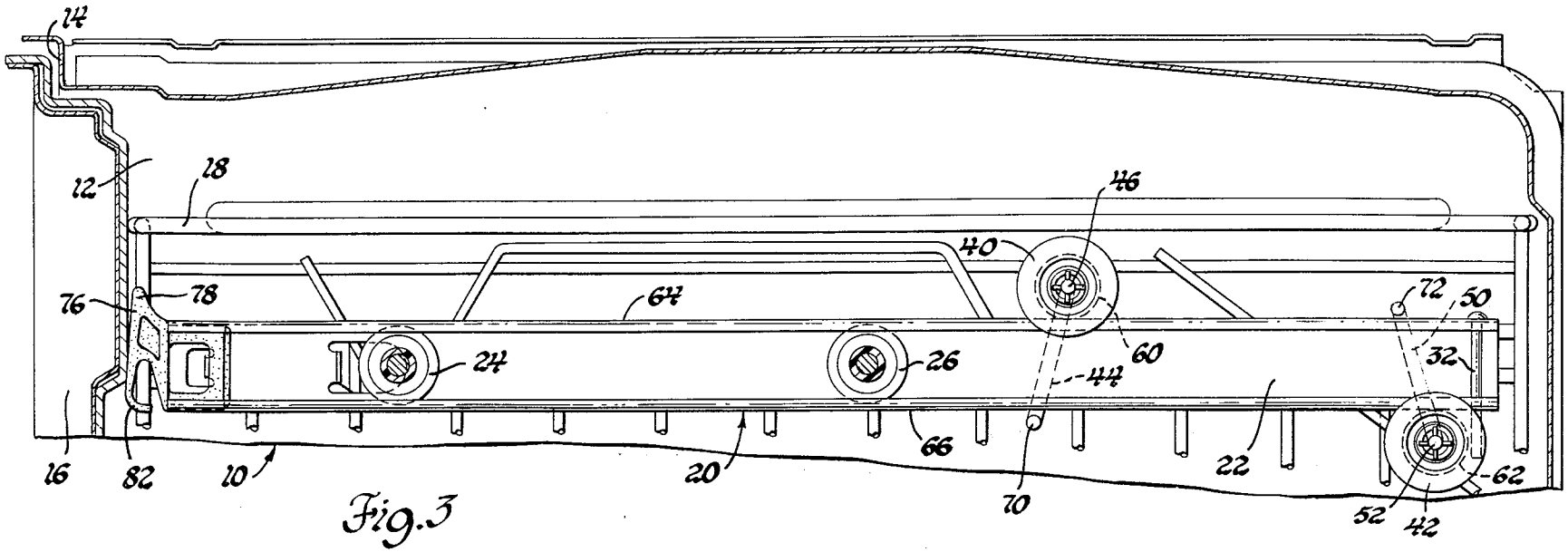
FIG. 3 is a sectional view taken along line 3 — 3 in FIG. 1 with the dish rack inside the dishwasher tub for a dishwashing cycle.
Figure 4:
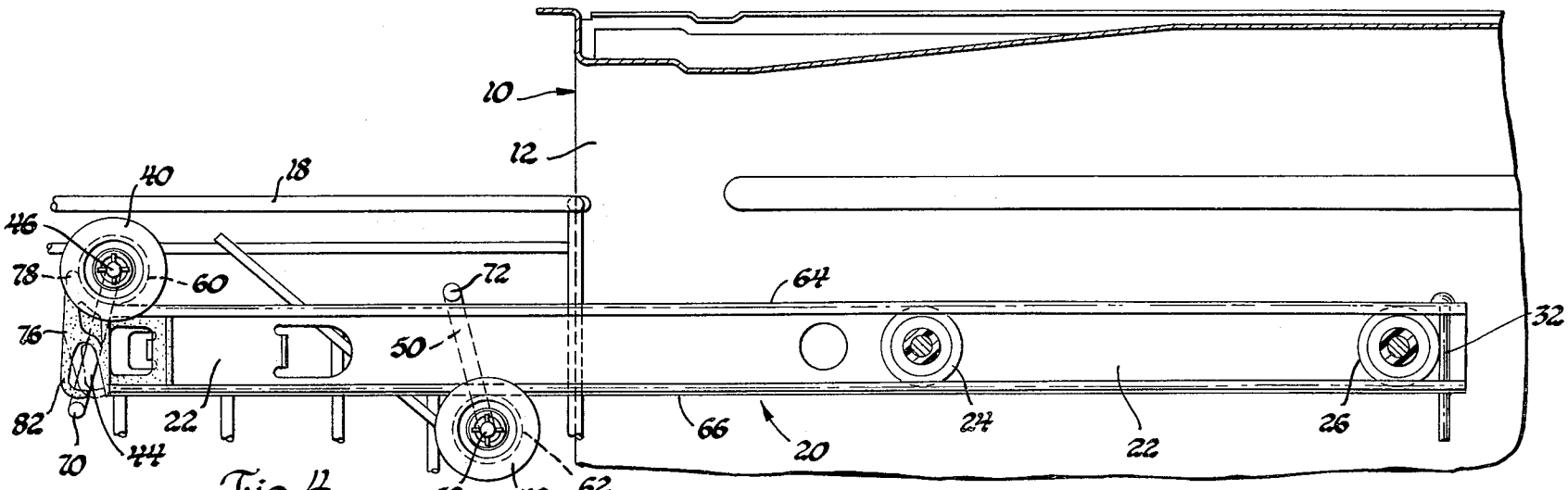
FIG. 4 is a view like FIG. 3 with the dish rack slidably moved outside the dishwasher tub for loading and unloading the dishes.

Rack 18, in accordance with this invention, includes a pair of rigid retention pins or members 70, 72 projecting sidewardly from the rack. Pin 72 overlies the top 64 of rail 22 and is spaced therefrom. Pin 70 underlies the bottom 66 of the rail and is spaced therefrom. Both pins are laterally and vertically offset from each other and rotationally offset from the rollers 40, 42 to prevent the rack from tipping upwardly. Thus, as the front of the rack is lifted, pivoting about roller 40, pin 72 will first engage the top of the rail and, if lifting continues, then pin 70 will engage the bottom of the rail, thereby to limit further pivotal movement of the rack before the rail can dislodge from the grooved rims of the rollers (FIG. 3). For this purpose the spacing of the pins from the rail should be less than the depth of the grooved rim in their vertically adjacent roller. As shown, such pins may be formed as integral terminal portions of rack wires 44, 50 respectively giving such wires rather a C-shape.

A rail guide cap 76 is snapped onto the front of rail 22. The cap has a raised abutment 78 on the top thereof to locate the rack in its loading position (FIG. 4) when roller 40 comes to rest against the abutment during outward or forward movement of the rack. A flexible latch finger 82 is formed on the bottom of the cap and integral therewith. The flexible finger normally blocks the retention pin 70 when one attempts to lift the rack from its loading position (FIG. 4 - solid line), thereby maintaining the rack latched onto the rail. This anti-lift feature prevents the inadvertent upwardly tipping removal of the rack from the rail. Finger 82 may be manually flexed out of the blocking relation with pin 70 to permit the upwardly tipping removal of the rack from the rail (FIG. 4 - phantom line), thereby to facilitate the complete release and removal of the rack from the tub and rail. Guide cap 76 will have the necessary flexibility in a dishwasher environment if formed of polypropylene with the thickness of finger 82 being 0.09 inch.

Another feature of this invention provides for the interchangeability of the guide caps 76 and rails 22 at each side of the dishwashing chamber. For this purpose, the front of rail 22 is squared off to receive the guide cap 76 which stops roller 40 on top of the rail when the rack is in its loading position. This prevents the roller from moving across the joint between rail and cap as the rack is moved between loading and washing positions, thereby to prevent damage to the rolling surface of the relatively soft plastic roller 40. To achieve these advantages retention pin 70 on rack wire 44 is offset about 14° forwardly of the terminal portion 46 thereof which supports and serves as the axis of roller 40 on the rack. The forward positioning of pin 70 (FIG. 4) clears the front end of the rail and aligns the pin in blocking relation with the unflexed finger 82 so that the rack may be selectively normally retained on the rail or manually removed therefrom.

While the embodiment of the present invention as herein disclosed constitutes a preferred form, it is to be understood that other forms might be adopted.

What is claimed is:

1. In a dishwasher of the front loading type having a washing chamber and an access opening thereto, a dish supporting rack slidably mounted in the chamber for movement between a loading position wherein the rack extends at least partially out through the access opening and a washing position wherein the rack is fully within the chamber, the improvement comprising a supporting rail at each side of said rack affixed to a side wall of the washer chamber, a pair of rollers affixed on said rack at the rear thereof, said rollers being both laterally and vertically offset from each other and each having a grooved rim astride opposite sides of said rail adapted for keeping the rack astride the rail and preventing the front of the rack from tipping downwardly during movement between loading and washing positions, said rack including a pair of retention pins laterally and vertically offset from each other extending into the vertical plane of said rail and spaced from said rail, the spacing of said retention pins from said rail being sufficiently close in conjunction with the depth of said grooved rims so that the upper one of said pins engages said rail as the front of said rack is tipped upwardly about the upper one of said rollers and the lower one of said pins engages said rail as the front of said rack is tipped further upwardly about the upper one of said pins thereby to keep the rack astride the rail by preventing the rack front from tipping sufficiently upwardly to release the grooved rim of each roller from the opposite sides of said rail, and means between the front of said rail and the lower one of said pins for releasably latching said rack against removal from said rail when the rack is in its loading position.

2. In a dishwasher of the front loading type having a washing chamber and an access opening thereto, a dish supporting rack slidably mounted in the chamber for movement between a loading position wherein the rack extends at least partially out through the access opening and a washing position wherein the rack is fully within the chamber, the improvement comprising a supporting rail at each side of said rack and affixed to a side wall of the washer chamber, a pair of rollers affixed on said rack at the rear thereof, said rollers being both laterally and vertically offset from each other and each having a grooved rim astride said rail for supporting the rack and preventing the front thereof from tipping downwardly during movement between loading and washing positions, said rack including a pair of retention pins extending into the vertical plane of said rail, said retention pins being sufficiently laterally and vertically offset from each other in conjunction with said grooved rims being sufficiently deep so that the upper one of said pins engages said rail as the front of said rack is tipped upwardly about the upper one of said rollers and the lower one of said pins engages said rail as the front of said rack is tipped upwardly about the upper one of said pins thereby to prevent the rack front from tipping upwardly sufficiently to release the grooved rim of each roller from said rail, and a rail cap on the front of said rail, said cap having a raised abutment on the top thereof to locate the rack in its loading position, and a flexible finger on the bottom thereof, said flexible finger being in normally blocking relation to the lower one of said retention pins when said rack is in its loading position to prevent the inadvertent upwardly tipping removal of the rack from said rail, said finger being manually flexed out of said blocking relation with said lower pin to release said pin and permit upwardly tipping the front of said rack for the release and removal of the rack from the rail.

3. In a dishwasher of the front loading type having a washing chamber and an access opening thereto, a rack for supporting dishes to be washed slidably mounted in the chamber for movement between a loading position wherein the rack extends at least partially out through the access opening and a washing position wherein the rack is fully within the chamber, the improvement comprising a supporting rail at each side of said rack slidably mounted on a first pair of rollers affixed to a side wall of the washer chamber, a second pair of rollers affixed on said rack at the rear thereof, said last-named rollers being both laterally and vertically offset from each other and astride said rail for supporting the rack and preventing the front thereof against tipping downwardly during movement between loading and washing positions, said rack including a pair of retention pins overlapping said rail in spaced relation thereto and laterally and vertically offset from each other, one of said retention pins being on the opposite side of said rail from one of the rollers in said second pair of rollers and the other of said retention pins being on the opposite side of said rail from the other of said rollers in said second pair to prevent the rack from tipping upwardly, and a rail cap on the front of said rail, said cap having a raised abutment on the top thereof to locate the rack in its loading position, and an integral flexible finger on the bottom thereof, said flexible finger normally blocking the lower one of said retention pins when said rack is in its loading position to prevent the inadvertent upwardly tipping removal of the rack from said rail, said finger being manually flexed out of the blocking relation with said lower pin to permit the upwardly tipping removal of the rack from the rail.

4. In a dishwasher of the front loading type having a washing chamber and an access opening thereto, a rack for supporting dishes to be washed slidably mounted in the chamber for movement between a forward loading position wherein the rack extends at least partially out through the access opening and a rearward washing position wherein the rack is fully within the chamber, the improvement comprising at each side of said rack a supporting rail slidably mounted on a first pair of rollers affixed to a side wall of the washer chamber, each of said rails configured with a generally squared-off front end to make the rails interchangeable with each other, a second pair of rollers affixed on said rack at the rear thereof, said last-named rollers being both laterally and vertically offset from each other and astride a rail with the forward roller adapted to travel on top of said rail for supporting the rack and preventing the front thereof against tipping downwardly throughout movement of said rack between loading and washing positions, said rack including a pair of retention pins overlapping said rail in spaced relation thereto and laterally and vertically offset from each other, one of said retention pins being on the opposite side of said rail from said forward roller in said second pair of rollers and the other of said retention pins being on the opposite side of said rail from the other of said rollers in said second pair to prevent the rack from tipping upwardly, and a rail cap on the front of said rail, said cap having a raised abutment on the top thereof to stop said forward roller on top of said rail and locate the rack in its loading position and said cap having an integral manually flexible finger on the bottom thereof, the retention pin opposite said forward roller being forwardly of the axis thereof and the front end of said rail when said rack is in its loading position, said flexible finger normally blocking said last-named retention pin when said rack is in its loading position to prevent the inadvertent upwardly tipping removal of the rack from said rail, said finger being manually flexed out of blocking relation with said last-named pin to permit the upwardly tipping removal of the rack from said rail.

5. The improved dish supporting rack of claim 1 wherein the affixation of one of said pair of rollers on said rack is by a C-shaped wire, one terminal portion of which supports the roller and the other terminal portion of which is one of said pair of retention pins.

* * * * *